US006481643B1

(12) United States Patent
Chen

(10) Patent No.: US 6,481,643 B1
(45) Date of Patent: Nov. 19, 2002

(54) SPRAY HEAD STRUCTURE OF A WATER SPRINKLER

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/162,051

(22) Filed: Jun. 5, 2002

(51) Int. Cl.[7] ..... A62C 31/02; B05B 15/06

(52) U.S. Cl. ..... 239/390; 239/391; 239/392; 239/393; 239/394; 239/532; 239/436

(58) Field of Search ..... 239/390, 391, 239/392, 393, 394, 396, 436, 437, 442, 548, 532

(56) References Cited

U.S. PATENT DOCUMENTS 5,823,442 A * 10/1998 Guo ..... 239/394
6,164,566 A * 12/2000 Hui-Chen ..... 239/394
6,230,988 B1 * 5/2001 Chao ..... 239/394
6,341,737 B1 * 1/2002 Chang ..... 239/394

* cited by examiner

*Primary Examiner*—Robin O. Evans
(74) *Attorney, Agent, or Firm*—Harrison & Egbert

(57) ABSTRACT

A water spray head structure includes a connector, a fixation seat provided with a water hole and fastened to the connector a rotary seat provided with a first water guide hole and a second water guide hole and fastened rotatably to the fixation seat, a cap fastened to the rotary seat and provided with a perforated nozzle for discharging fine streams of water at such time when the first water guide hole of the rotary seat is aligned with the water hole of the fixation seat, and a spout disposed in the cap for discharging rough streams of water at such time when the second water guide hole of the rotary seat is in alignment with the water hole of the fixation seat.

1 Claim, 7 Drawing Sheets

SPRAY HEAD STRUCTURE OF A WATER SPRINKLER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lawn sprinkler, and more particularly to a spray head structure of the lawn sprinkler.

BACKGROUND OF THE INVENTION

As shown in FIG. 1, a prior art spray head 14 is provided with a cap 11 which is provided with a number of jet nozzles 10 and a fastening portion 13 by which the cap 11 is fastened with the spray head 14 such that an inner threaded portion 12 of the fastening portion 13 is engaged with an outer threaded portion 15 of the spray head 14.

The prior art structure as described above is defective in design in that the cap 11 is exposed and is therefore vulnerable to being acted on by external forces, thereby resulting in detachment of the cap 11, or damage to the cap 11. Without the cap 11, the prior art spray head 14 is in fact useless. With the cap 11 being damaged, the prior spray head 14 is certain to fail to live up to what it is expected to perform.

BRIEF SUMMARY OF THE INVENTION

The primary objective of the present invention is to provide a water sprinkler with a spray head structure which is free of the deficiencies of the prior art spray head structure described above.

In keeping with the principle of the present invention, the foregoing objective of the present invention is attained by the spray head structure comprising a cap, a rotary seat, a fixation seat, and a connector. The cap is fastened with the rotary seat which is in turn fastened with the fixation seat. The fixation seat is mounted in the connector. The present invention is characterized by the cap which has a number of jet nozzles and a spout. The jet nozzles are used to shoot out a spray of water while the spout is used to discharge a stream of water.

The features and the advantages of the present invention will be more readily understood upon a thoughtful deliberation of the following detailed description of the present invention with reference to the accompanying drawings.

DETAILED DESCRIPTION OF THE INVENTION

Figure 1:
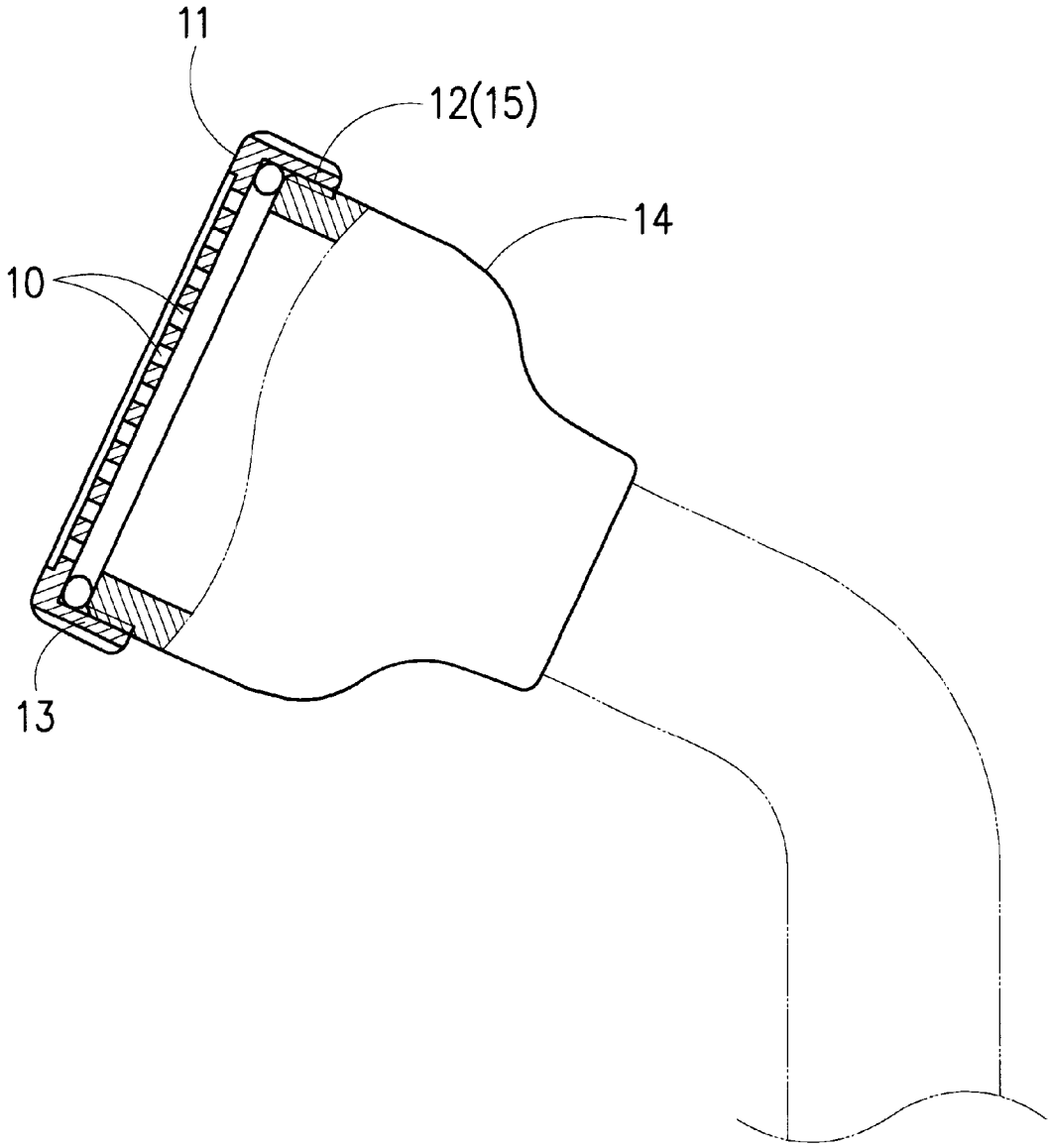
FIG.1 PRIOR ART
FIG. 1 shows a partial sectional view of a spray head of the prior art.
Figure 2:
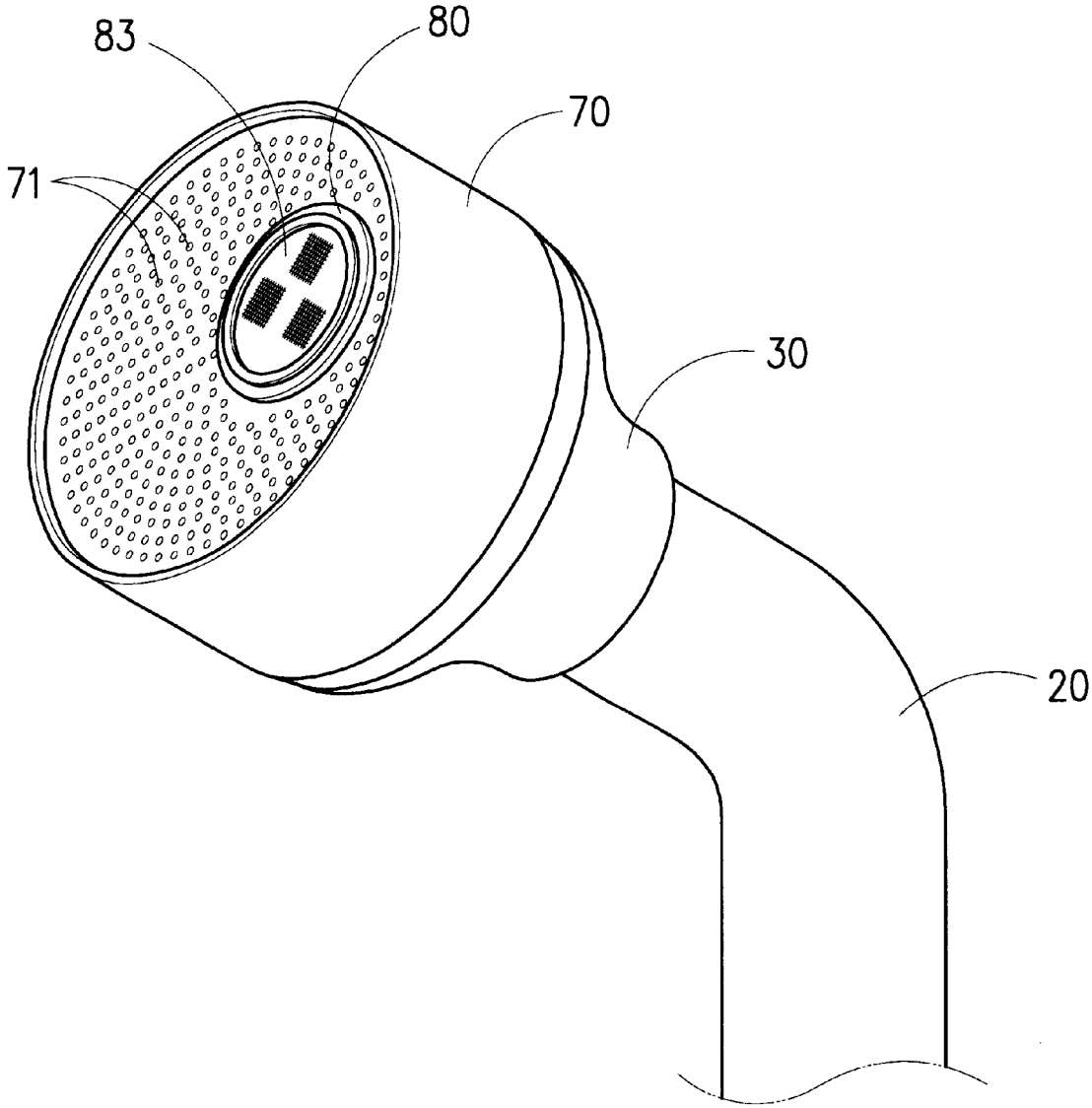
FIG. 2 shows a perspective view of the present invention.
Figure 3:
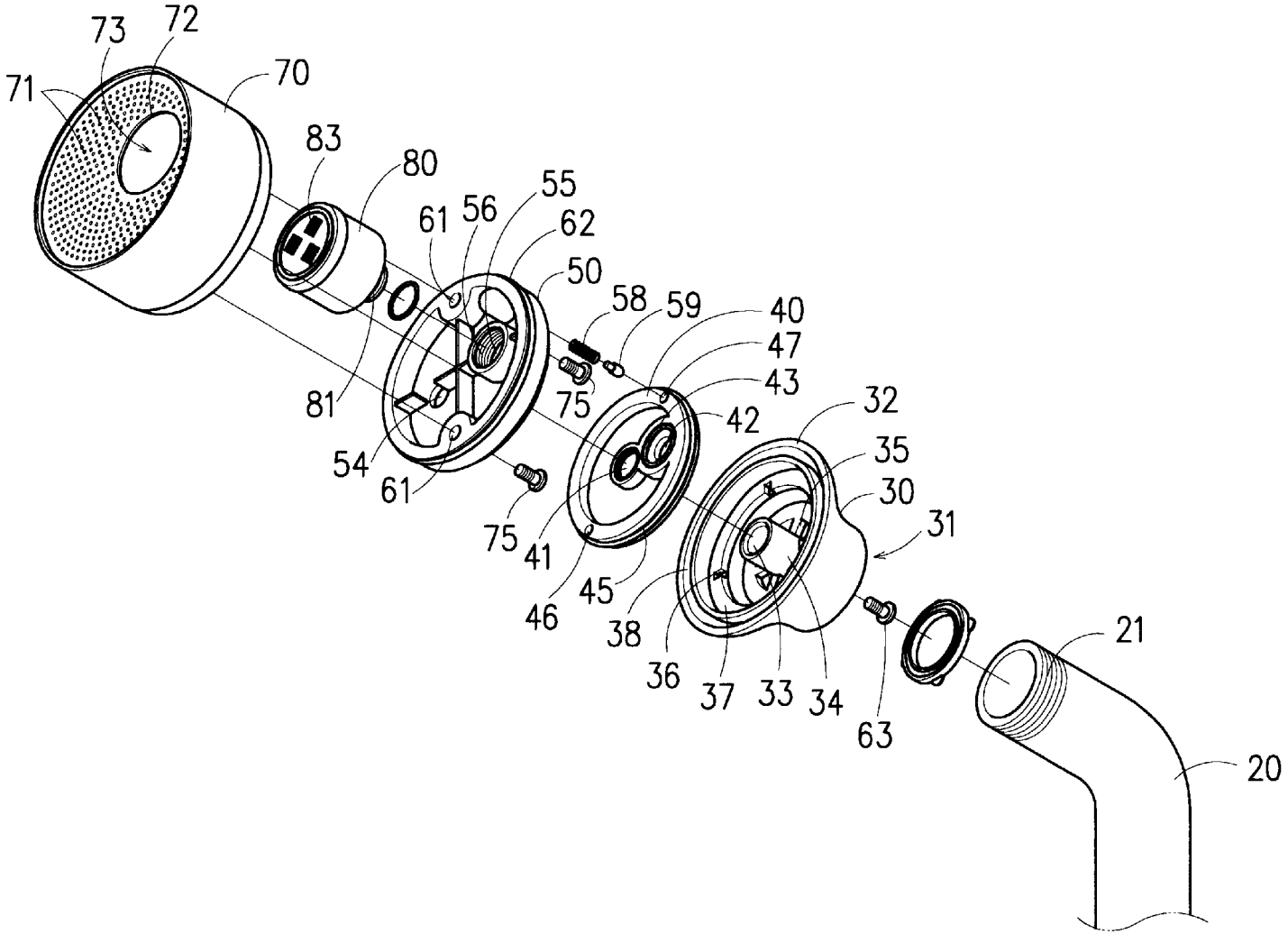
FIG. 3 shows an exploded perspective view of the present invention.

As shown in FIGS. 2–7, a spray head structure of the present invention is fastened with one end of a barrel 20 of a lawn sprinkler and is formed of a connector 30, a fixation seat 40, a rotary seat 50, a cap 70, and a spout 80.

The connector 30 is provided at a bottom end with an inner threaded portion 31, and at a top end with an enlarged portion 32. The connector 30 is fastened at the bottom end with the one end of the barrel 20 such that the inner threaded portion 31 of the connector 30 is engaged with an outer threaded portion 21 of the one end of the barrel 20. The connector 30 is further provided in the hollow interior of the enlarged portion 32 thereof with a fastening pillar 34 which is provided with an axial through hole 33 and a plurality of water holes 35 arranged at an interval in the periphery of the fastening pillar 34. The water holes 35 are in communication with the water duct of the barrel 20 and are surrounded by a seat slot 37 which is provided with a plurality of retaining edges 36. Located between the seat slot 37 and the end edge of the enlarged portion 32 is an annular groove 38.

Figure 4:
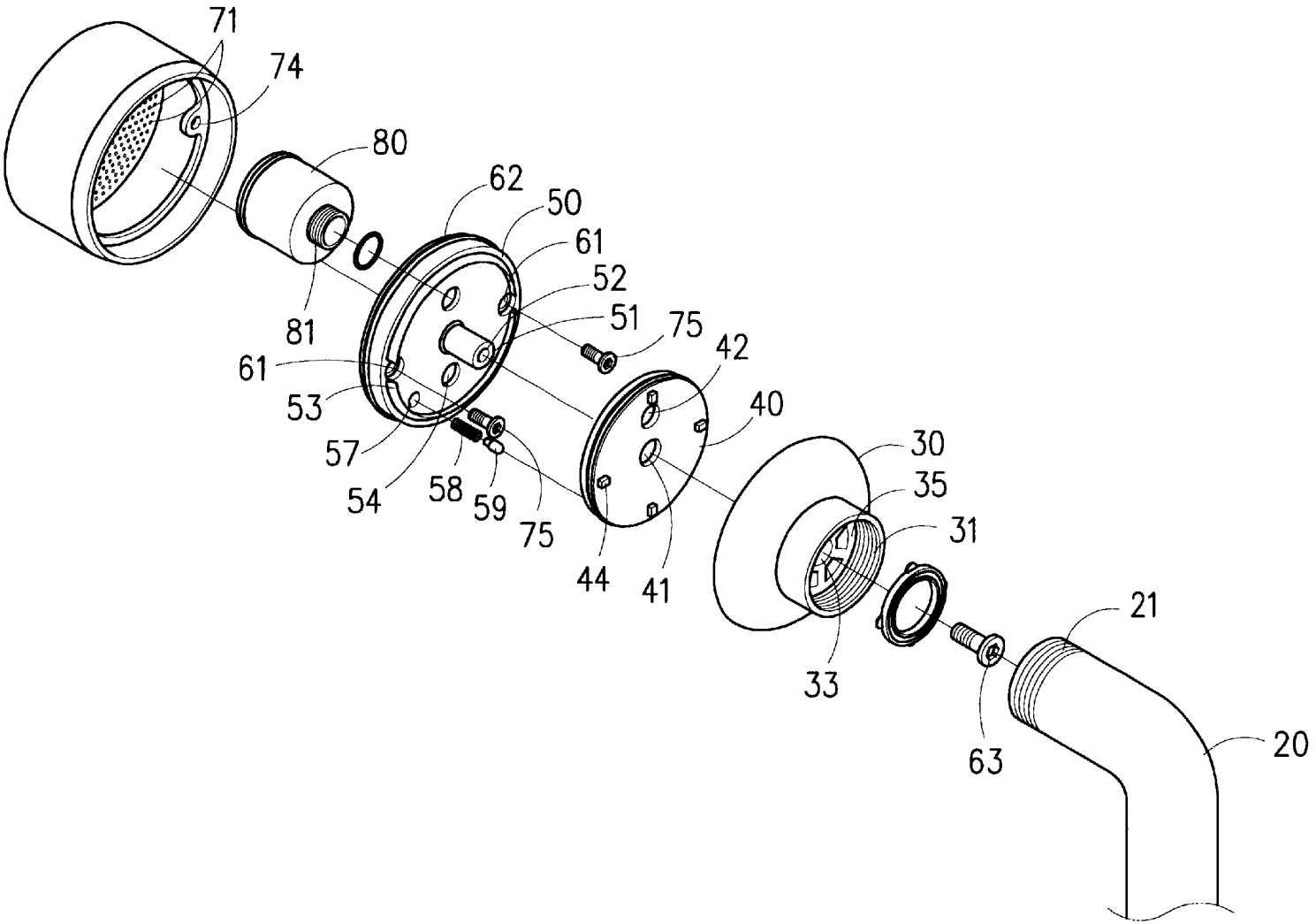
FIG. 4 shows another exploded perspective view of the present invention.

The fixation seat 40 is provided in the center with a through hole 41 corresponding in location to the axial through hole 33 of the fastening pillar 34 of the connector 30. The fixation seat 40 is located in the seat slot 37 of the connector 30 such that the through hole 41 is aligned with the axial through hole 33. The fixation seat 40 is eccentrically provided with a water hole 42 in communication with the water holes 35 of the connector 30. The water hole 42 is provided with a washer 43. The fixation seat 40 is provided in the underside with a plurality of retaining slots 44 in which the retaining edges 36 of the seat slot 37 of the connector 30 are retained. The fixation seat 40 is located in the seat slot 37 in conjunction with a washer 45. The fixation seat 40 is provided in the upper side with two retaining slots 46 and 47 opposite in location to each other. The rotary seat 50 is provided at the center of the underside thereof with a projection 51 which is provided with a threaded hole 52. The rotary seat 50 is rotatably fastened with the fixation seat 40 and the connector 30 such that the projection 51 is put through the through hole 41 of the fixation seat 40 and the axial through hole 33 of the connector 30, and that the threaded hole 52 of the projection 51 of the rotary seat 50 is engaged with a fastening bolt 63, and further that an annular ridge 53 of the underside of the rotary seat 50 is received in the annular groove 38 of the connector 30. The rotary seat 50 is eccentrically provided with a first water guide hole 54 and a second water guide hole 55. The rotary seat 50 can be turned such that the first water guide hole 54 and the second water guide hole 55 can be in alignment with the water hole 42 of the fixation seat 40. The second water guide hole 55 is provided with a threaded tube 56. The rotary seat 50 is provided in the underside with a receiving slot 57 for receiving a spring 58 and a pin 59, as shown in FIG. 4. The pin 59 is forced by the spring force of the spring 58 to extend into the first retaining slot 46 and the second retaining slot 47 of the fixation seat 40 at the time when the first water guide hole 54 and the second water guide hole 55 of the rotary seat 50 are respectively aligned with the water hole 42 of the fixation seat 40. The rotary seat 50 is further provided with two fastening holes 61. The rotary seat 50 is still provided in the upper side with a washer 62.

The cap 70 has an open bottom end and a closed top end which is provided with a number of jet nozzles 71 for shooting out fine streams of water. The closed top end of the cap 70 is further provided with an opening 72 corresponding in location to the threaded tube 56 of the second water guide hole 55 of the rotary seat 50. The cap 70 is further provided in the interior with a water channel 73 which is in turn provided with two threaded holes 74 corresponding in location to the two fastening holes 61 of the rotary seat 50. The cap 70 is fastened with the rotary seat 50 by two fastening bolts 75 which are engaged with the two threaded holes 74 of the cap 70 via the two fastening holes 61 of the rotary seat 50. As result, the cap 70 is turned along with the rotary seat 50.

The spout 80 is provided in the bottom end with a threaded portion 81. The spout 80 is disposed in the interior of the cap 70 such that the threaded portion 81 of the bottom end of the spout 80 is engaged with the threaded tube 56 of the second water guide hole 55 of the rotary seat 50, and that the top end of the spout 80 is fitted into the opening 72 of the cap 70. The spout 80 is provided in the interior with a sponge layer 82 and a filtration layer 83, as shown in FIG. 5.

Figure 5:
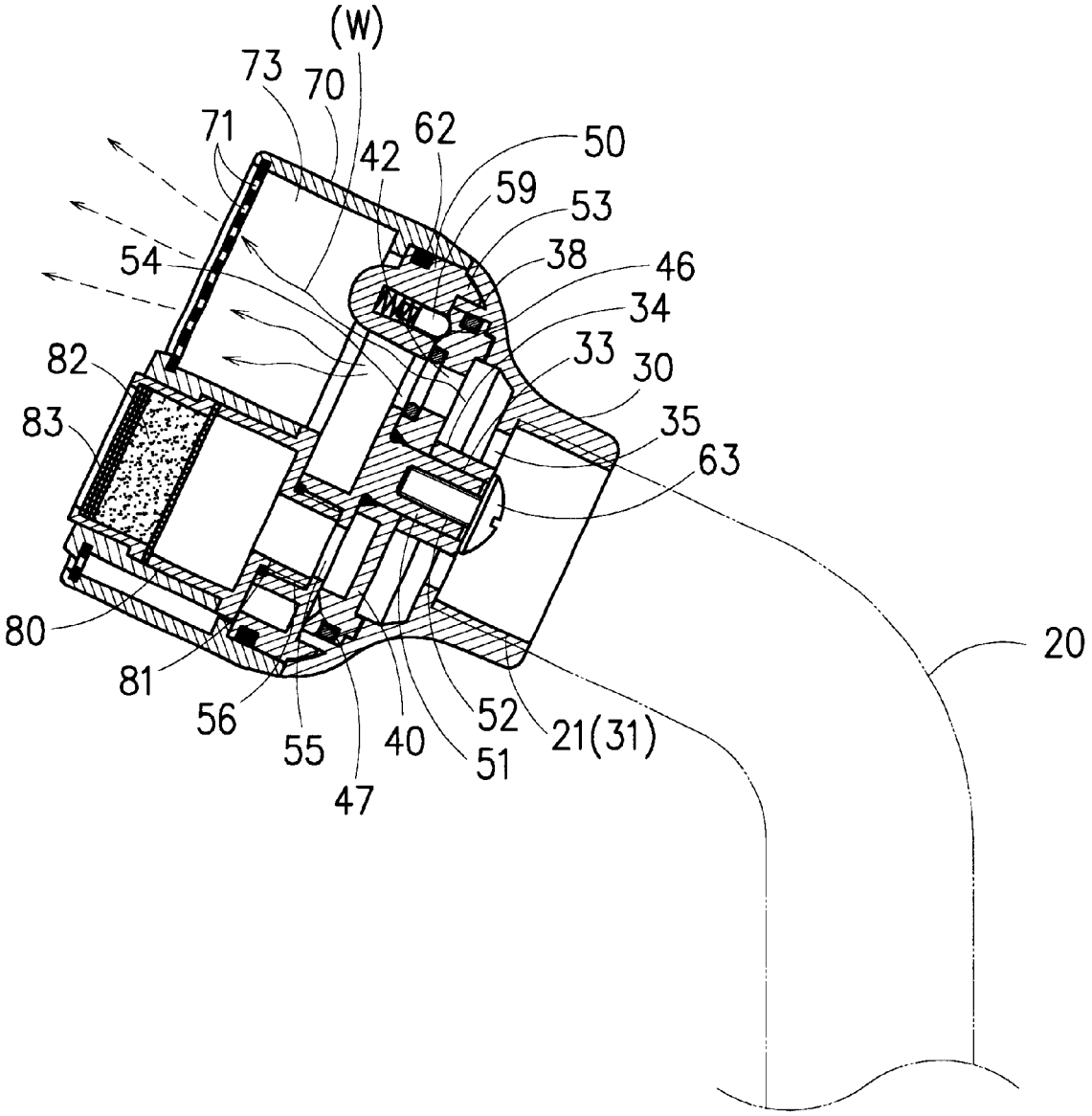
FIG. 5 is a longitudinal sectional view to show the jet nozzles of the cap of the present invention in action.

As shown in FIG. 5, the rotary seat 50 and the cap 70 are so turned that the pin 59 of the rotary seat 50 is retained in the first retaining slot 46 of the fixation seat 40, thereby resulting in alignment of the first water guide hole 54 of the rotary seat 50 with the water hole 42 of the fixation seat 40. As a result, water (W) is discharged in fine streams via the jet nozzles 71 of the cap 70.

Figure 6:
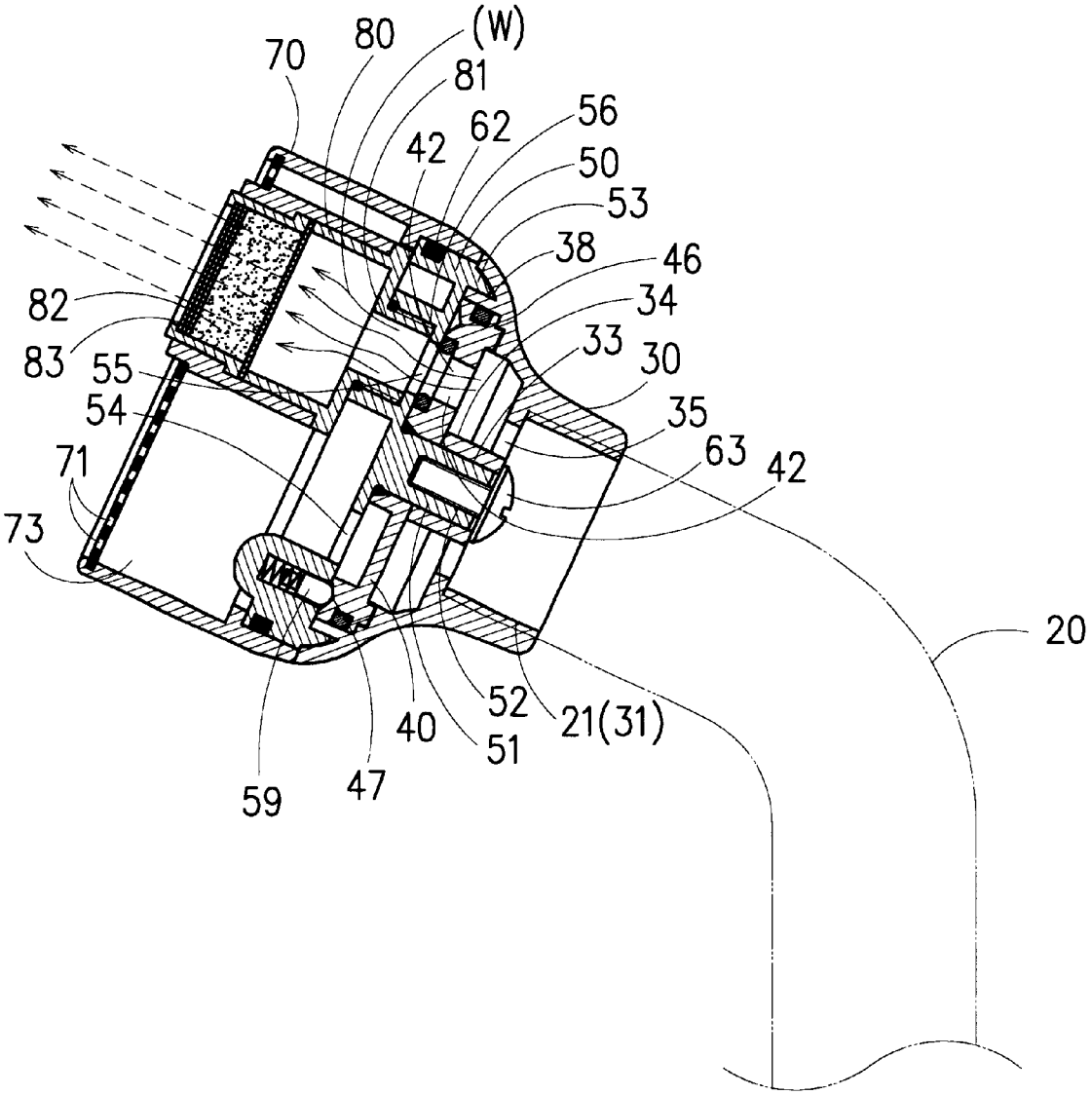
FIG. 6 is a longitudinal sectional view to show the spout of the cap of the present invention in action.
Figure 7:
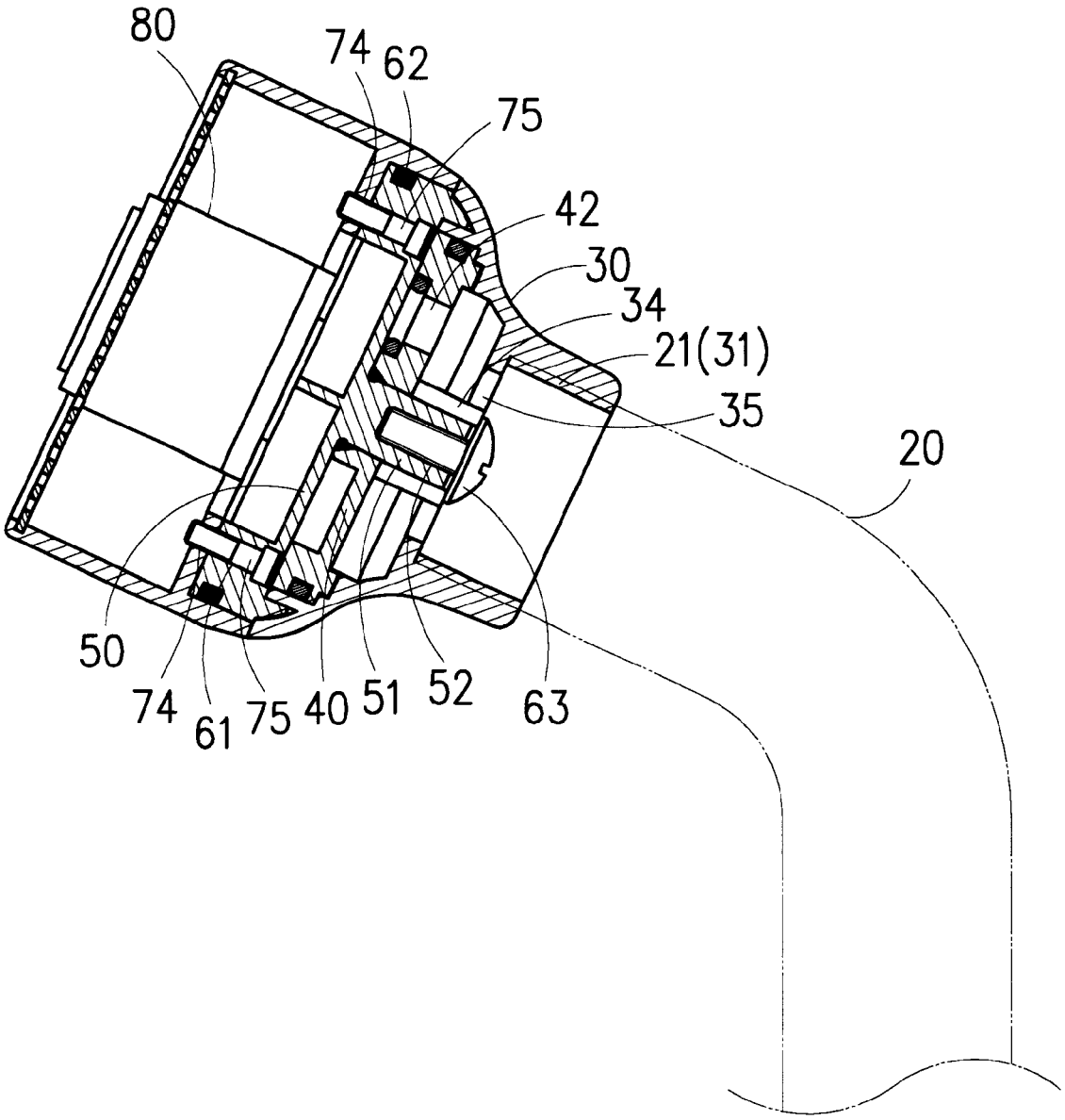
FIG. 7 shows a longitudinal sectional view of the present invention.

As shown in FIG. 6, when the rotary seat 50 and the cap 70 are so turned that the pin 59 of the rotary seat 50 is retained in the second retaining slot 47 of the fixation seat 40, thereby resulting in alignment of the second water guide hole 55 of the rotary seat 50 with the water hole 42 of the fixation seat 40. As a result, water (W) is discharged in rough streams via the spout 80.

I claim:

1. A spray head structure of a water sprinkler, said spray head structure comprising:

a connector fastened at a bottom end to a top end of a barrel of a top end of a barrel of the water sprinkler, said connector provided in a hollow interior of a top end thereof with a fastening pillar which is comprised of an axial through hole and a plurality of water holes in communication with a water duct of the barrel of the water sprinkler, said water holes being surrounded by a seat slot which is comprised of a plurality of retaining edges, said connector being further provided in the top end thereof with an annular groove;

a fixation seat provided in a center with a through hole corresponding in location to said axial through hole of said fastening pillar of said connector, said fixation seat further comprised of a water hole, a plurality of retaining slots located in an underside thereof, and a first retaining slot and a second retaining slot which are located in an upper side thereof whereby said fixation seat is disposed in said seat slot of said connector such that said through hole of said connector is aligned with said axial through hole of said connector, and that said water hole of said fixation seat is in communication with said water holes of said connector, and further that said retaining slots of said fixation seat retain said retaining edges of said connector;

a rotary seat comprising, in an underside, a projection and an annular ridge, with said projection being comprised of a threaded hole, said rotary seat further provided with a first water guide hole and a second water guide hole whereby said rotary seat is rotatably fastened to said fixation seat and said connector by a fastening bolt such that said projection of said rotary seat is put through said through hole of said connector, and that said threaded hole of said projection of said rotary seat is engaged with said fastening bolt, and further that said annular ridge of said rotary seat is received in said annular groove of said connector, said rotary seat being further comprised of, in the underside, a receiving slot for receiving a spring and a pin urged by said spring, said rotary seat being turned in relation to said fixation seat such that said pin of said rotary seat is retained in said first retaining slot of said fixation seat, thereby resulting in alignment of said first water guide hole of said rotary seat with said water hole of said fixation seat, said rotary seat being turned in relation to said fixation seat such that said pin of said rotary seat is retained in said second retaining slot of said fixation seat, thereby resulting in alignment of said second water guide hole of said rotary seat with said water hole of said fixation seat;

a cap comprising an open bottom end and a closed top end, with said top end being provided with a number of jet nozzles for shooting out fine streams of water, said top end further provided with an opening corresponding in location to a threaded tube of said second water guide hole of said rotary seat, said cap further provided in an interior with a water channel which is in turn provided with two threaded holes corresponding in location to two fastening holes of said rotary seat whereby said cap is fastened to said rotary seat by two fastening bolts which are engaged with said two threaded holes of said cap via said two fastening holes of said rotary seat; and a spout comprising, in a bottom end, a threaded portion, and in a top end, a sponge layer and a filtration layer, whereby said spout is disposed in said cap such that said threaded portion of the bottom end of said cap is engaged with said threaded tube of said second water guide hole of said rotary seat, and that the top end of said spout is fitted into said opening of said cap for discharging water in rough streams at the time when said cap is turned along with said rotary seat such that said pin of said rotary seat is retained in said second retaining slot of said fixation seat, thereby resulting in alignment of said second water guide hole of said rotary seat with said water hole of said fixation seat.

* * * * *